US012710240B2

(12) United States Patent
Lewandowski et al.

(10) Patent No.: US 12,710,240 B2
(45) Date of Patent: Aug. 18, 2026

(54) HEAT EXCHANGER TURNAROUND SECTION

(71) Applicant: Hamilton Sundstrand Corporation, Charlotte, NC (US)

(72) Inventors: Rafał Lewandowski, Mrowiny (PL); Artur Hilgier, Długołęka (PL)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 157 days.

(21) Appl. No.: 18/588,568

(22) Filed: Feb. 27, 2024

(65) Prior Publication Data

US 2024/0288234 A1 Aug. 29, 2024

(30) Foreign Application Priority Data

Feb. 28, 2023 (EP) ..... 23461525

(51) Int. Cl.
*F28F 9/26* (2006.01)
*F28D 7/00* (2006.01)
*F28F 1/08* (2006.01)

(52) U.S. Cl.
CPC ..... *F28F 9/26* (2013.01); *F28D 7/0033* (2013.01); *F28F 1/08* (2013.01); *F28F 2250/106* (2013.01); *F28F 2255/00* (2013.01)

(58) Field of Classification Search
CPC .... F28D 7/0033; F28D 1/0383; F28D 1/0475; F28D 1/05358; F28D 1/0476; F28D 1/0391
See application file for complete search history.

(56) References Cited

U.S. PATENT DOCUMENTS

| | | | | |
|---|---|---|---|---|
| 10,809,007 | B2 | 10/2020 | Martinez et al. | |
| 2017/0115066 | A1* | 4/2017 | Adomat | F28D 1/0213 |
| 2017/0234622 | A1* | 8/2017 | Mizushita | F28F 3/08 165/166 |
| 2017/0328640 | A1* | 11/2017 | Schwalm | F28D 7/0016 |
| 2021/0071968 | A1* | 3/2021 | Streeter | F28F 9/0268 |
| 2021/0180886 | A1* | 6/2021 | Yun | F28F 1/022 |

(Continued)

FOREIGN PATENT DOCUMENTS

| | | | |
|---|---|---|---|
| CA | 3005197 | A1 | 11/2018 |
| EP | 3193127 | A1 | 7/2017 |

(Continued)

OTHER PUBLICATIONS

European Search Report for Application No. 23461525.0, mailed Aug. 21, 2023, 5 pages.

*Primary Examiner* — Devon Lane
(74) *Attorney, Agent, or Firm* — CANTOR COLBURN LLP

(57) ABSTRACT

A turnaround section for use with a two-pass crossflow heat exchanger. The turnaround section includes an arcuate housing and a plurality of arcuate fluid flow channels radially spaced within the housing, each arcuate channel having a first end configured, in use, to receive a first fluid from flow channels of a heat exchanger core and a second end to return the first fluid to return channels of the core. A plurality of separators are provided between each adjacent pair of arcuate channels to form further channels between the arcuate channels that extend and provide for flow of a second fluid in a plane transverse to the plane of the arcuate channels.

11 Claims, 3 Drawing Sheets

(56) References Cited

U.S. PATENT DOCUMENTS

| | | | | |
|---|---|---|---|---|
| 2021/0231389 | A1* | 7/2021 | Ojanperä | F28F 9/0131 |
| 2021/0293483 | A1 | 9/2021 | Gerstler et al. | |
| 2021/0324820 | A1 | 10/2021 | Draenkow et al. | |
| 2021/0381730 | A1* | 12/2021 | Dittly | F28D 1/0476 |

FOREIGN PATENT DOCUMENTS

| | | | |
|---|---|---|---|
| WO | 2008125485 | A1 | 10/2008 |
| WO | 2012097797 | A2 | 7/2012 |

* cited by examiner

HEAT EXCHANGER TURNAROUND SECTION

CROSS REFERENCE TO RELATED APPLICATIONS

This application claims priority to European Patent Application No. 23461525.0 filed Feb. 28, 2023, the entire contents of which is incorporated herein by reference.

TECHNICAL FIELD

The present disclosure is concerned with the turnaround section in a heat exchanger.

BACKGROUND

Heat exchangers typically work by the transfer of heat between fluid flowing in parallel channels defined by metal plates of a heat exchanger core. A heat exchanger core is generally in the form of a block made up of layers of plates which define the channels through which the fluid flows. The channels are arranged such that hot fluid flows through some channels and cold fluid flows through other channels with the hot and cold channels arranged either vertically or horizontally adjacent each other such that heat is exchanged across the boundary between the channels. Thermal properties are improved by the introduction of turbulence in the flow channels and so, conventionally, a heat exchanger core comprises corrugated metal plates arranged adjacent each other so as to define corrugated flow channels for the heat exchange fluids.

Additive manufacture, or 3D printing, has recently become a preferred manufacturing method for many parts and components due to the fact that it is relatively quick and low cost and allows for great flexibility in the design of new components and parts. Due to the fact that components and parts made by additive manufacture (AM) can be quickly made in a custom designed form, as required, AM also brings benefits in that stocks of components do not need to be manufactured and stored to be available as needed. AM parts can be made of relatively light, but strong materials. As AM is becoming more popular in many industries, there is interest in manufacturing heat exchangers using AM.

In conventional heat exchanger channels, the viscous fluids that are commonly used create a thick boundary layer at the walls of the channels. This boundary layer presents a resistance to heat exchange across the channel walls and reduces the amount of energy that can be transferred through the channel wall by heat exchange. Additive manufacturing provides the opportunity to create new shapes of heat exchanger channel to address this problem.

One type of AM heat exchanger design has a so-called weave core in which wavy channels are formed for the hot and cold fluid and the hot and cold fluid channels are interwoven in a continuous manner. Such designs are typically cross-flow designs where the hot fluid flows through wavy channels in one direction and the cold fluid flows through wavy channels interlaced through the hot flow channels in a direction transverse to the one direction. The integrated geometry of the weave makes such heat exchangers most suitable for single pass designs—i.e. where the hot and cold fluid enters their respective channels at one end on one side/end of the core and exits at the opposite end.

In some cases, it is preferable to use a two-pass design—i.e. for each layer of the core, the fluid flows along a respective channel in one direction and is then turned around at a turnaround section of the core and flows back along a channel in the opposite direction, the fluid thus making two passes of the core. The turnaround section is typically provided by a so-called turnaround tank fitted to the end of the heat exchanger core, into which fluid flows from all of the channels and layers from the first pass section of the core. The turnaround section is shaped and may be provided with vanes or the like to ensure that the fluid follows the path required to change direction. The turnaround tank is commonly a tank defining a void, positioned at the end of the core, into which fluid flows from the first pass through the core and where the fluid direction is changed due to the velocity of the fluid flow as it flows through the tank to flow back through the second pass section of the core. Whilst such heat exchanger designs are useful for some heat exchange designs, no heat exchange occurs in the turnaround section. Further, the fluid distribution in the main core section can be disturbed due to the turnaround section design. Another issue with using a conventional turnaround tank design with such AM weave core heat exchanger designs is that the large voids required in such a turnaround tank to receive all of the fluid from all channels in a layer is difficult to manufacture using 3D printing/AM methods. There is a desire to provide an improved turnaround section design which can be easily formed using AM, which reduces waste of the heat energy in the fluid in that section and which mitigates the problems of disturbance and so improves the performance of the heat exchanger.

SUMMARY

According to the disclosure, there is provided a turnaround section for use with a two-pass crossflow heat exchanger, the turnaround section comprising an arcuate housing and a plurality of arcuate fluid flow channels radially spaced within the housing, each arcuate channel having a first end configured, in use, to receive a first fluid from flow channels of a heat exchanger core and a second end to return the first fluid to return channels of the core, and wherein a plurality of separators are provided between each adjacent pair of arcuate channels to form further channels between the arcuate channels that extend and provide for flow of a second fluid in a plane transverse to the plane of the arcuate channels.

BRIEF DESCRIPTION

Examples according to the disclosure will now be described with reference to the drawings. It should be noted that these are examples only and that variations are possible within the scope of the claims.

DETAILED DESCRIPTION

Figure 1:
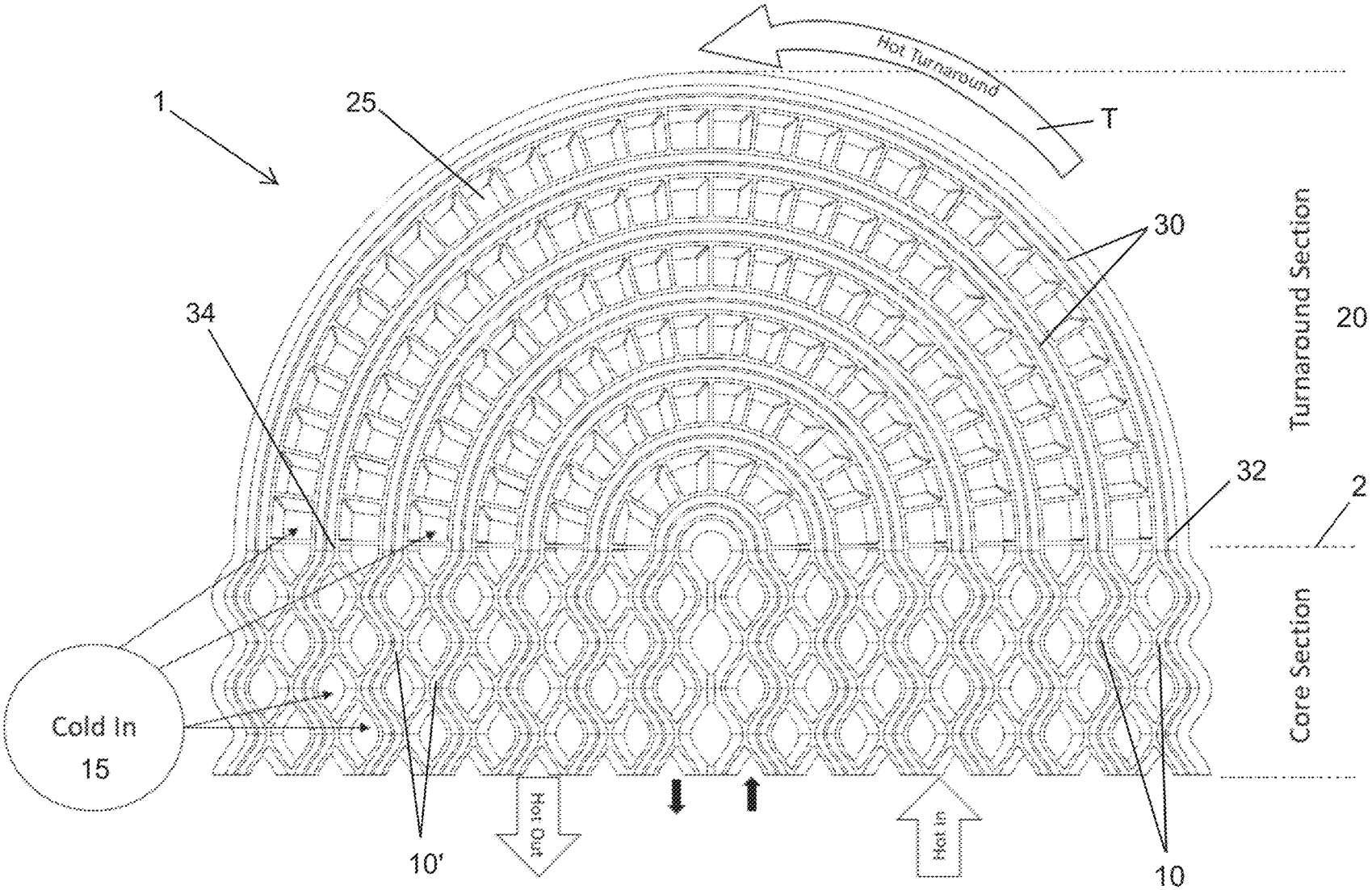
FIG. 1 is a sectional view through a single layer of a heat exchanger core with a turnaround section according to the disclosure.

The turnaround section of a two-pass cross-flow type heat exchanger will first be described with reference to FIG. 1 which shows a section through a single layer 1 of a heat exchanger core. In the example shown, the heat exchanger core is a weave core design where the hot fluid and cold fluid channels are interwoven in a cross-flow configuration. The layer comprises a plurality of first flow channels 10 extending in a first direction, along which one of the hot or cold fluid flows (here, the hot fluid). The hot fluid is provided via a manifold, not shown, as is well-known in the art. The first flow channels in this example are formed as adjacent wavy channels which can be easily manufactured using AM. The wavy shape of the channels improves the flow dynamics of the fluid as it flows along the channels. The hot fluid flows, in each layer, along the channels 10 in a first direction ('HOT IN'). At the end 2 of the layer opposite the hot fluid inlet manifold (not shown), a turnaround section 20 is provided into which the fluid from the channels 10 flows. The turnaround section has an arcuate form and the fluid flowing into the turnaround section follows the direction of arrow T back to the end 2 of the layer into return hot flow channels 10' which have the same configuration as the flow channels 10, the flow channels 10 and the return flow channels 10' together forming the layer 1. The turned around hot fluid then enters and flows back along the return channels 10' to the manifold end (not shown). The cold fluid is provided through the heat exchanger as a cross-flow to the hot fluid and so flows through channels 15 formed by the spaces between the hot flow channels 10,10' in the transverse direction (in FIG. 1 this is the direction into the page).

If the turnaround section were a conventional turnaround tank or large void, the hot fluid from all of the channels in all of the layers would meet and mix in that area and would be guided due to velocity and the shape of the arcuate turnaround section back to the return channels. In particular, for those return channels closer to the centre of the layer, the fluid in the turnaround section will be unlikely to be turned so much that it is able to enter them. As mentioned above, however, this is thermally inefficient and can be disruptive to the flow in the main core section, as well as being difficult to manufacture using AM.

The turnaround section 20 of this disclosure, therefore, has an arcuate housing 200 is formed as a number of arcuate channels 30 each coinciding at one end 32 with one or more of the first channels 10 and at an opposite end 34 with a corresponding return channel 10'. In other words, the channels 30 in the turnaround section are formed such that one or more of the first channels 10 feeds into each turnaround channel and the fluid flowing through that turnaround channel flows directly into a corresponding one or more of the return channels 10'. In the example shown, pairs of adjacent first channels meet at the end 2 of the layer and feed into a common turnaround channel 32 which then, in turn, at its opposite end 34, feeds into the ends of two adjacent return channels. It is feasible that the channels 10, 10' of the main core section are formed differently from the design shown in FIG. 1 and so the arcuate channels 30 of the turnaround section 20 may each be associated with only one or more than two first/return channels. What is important is that the fluid flowing in the first channels is directed into arcuate channels in the turnaround section and these then feed the fluid back into the return channels.

To ensure the required structural strength and retain the proper positioning and structure of the turnaround channels 30, as well as to provide a secondary heat transfer surface, separators e.g. fins 40 are formed between adjacent turnaround channels 30. The number and dimensions of the turnaround channels and the separators can be varied according to the heat exchanger design.

The heat exchange properties of this design may be further enhanced by using the spaces between the arcuate turnaround channels and between the separators as channels 25 through which the transverse cold air is flowed in the same way as in the main core section. The turnaround section then participates in the heat exchange function which improves efficiency and performance of the heat exchanger.

As mentioned above, the cold flow channels in the main core section provide turbulent flow if the hot channels are wavy, which improves the thermal efficiency of the heat exchanger. This advantage can also be obtained in the turnaround section if the separators and/or the turnaround channels have a wavy shape.

Figure 2:
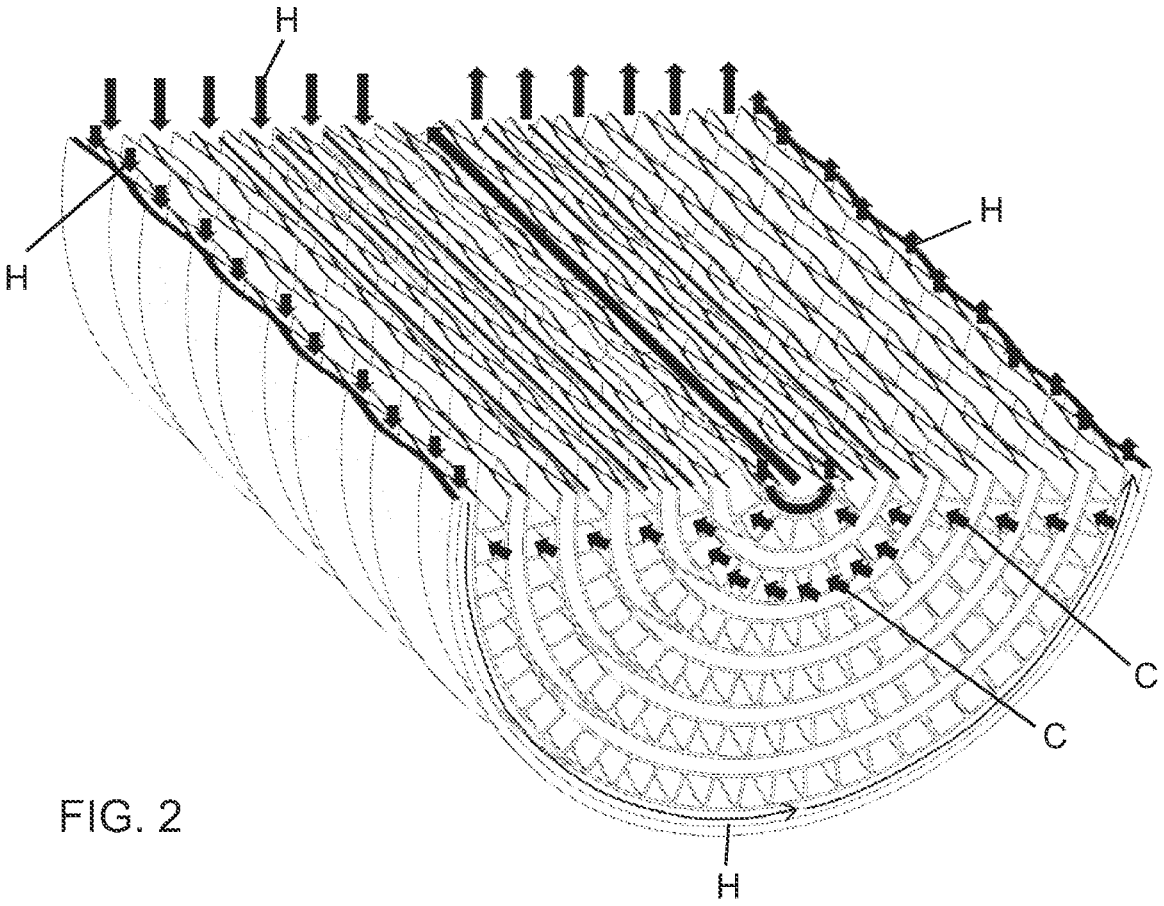
FIG. 2 shows a section, in 3D, of a turnaround section according to the disclosure.

FIG. 2 shows a sectional view of a turnaround section such as described above and shown in FIG. 1 to show the flow. Arrows H show the flow of the hot fluid and arrows C show the flow of cold fluid. It should be noted that the hot and cold fluids and channels could be the other way around—i.e. where we have 'hot' above, this could be interchanged with 'cold' and vice versa for different types of heat exchanger.

The design of the turnaround section with its channels and separators lends itself to being formed easily by additive manufacture and so the core and turnaround can be integrally formed by AM. This allows the heat exchanger to be manufactured quickly, easily and inexpensively compared to conventional heat exchangers.

Figure 3:
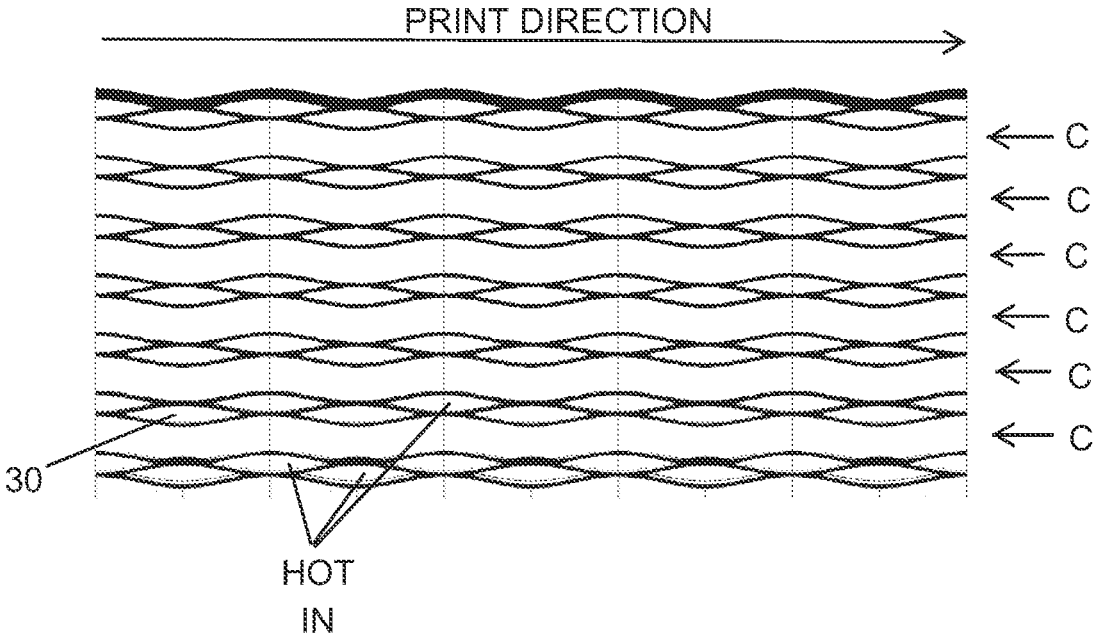
FIG. 3 illustrates the how a turnaround section according to the disclosure can be printed using additive manufacture.

This can be explained with reference to FIG. 3 which is an axial section view of the turnaround section where the cold flow is indicated by arrows C and the hot flow is through channels 30 into the plane of the page and the print direction is indicated by the 'PRINT DIRECTION' arrow. The printing direction therefore corresponds to the printing direction of the weave core. The design allows residual powder created during the AM process to be easily removed as the cold channels have a passage that can be seen through the entire channel. The turnaround channels also allow for relatively easy powder removal due to their simple geometry.

Figure 4:
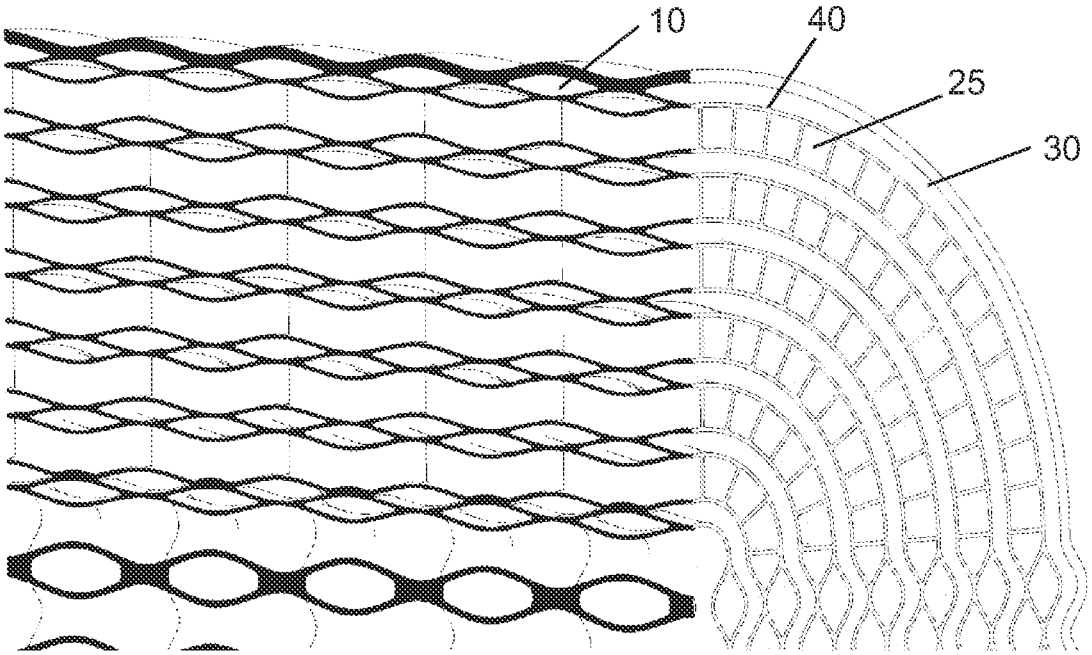
FIG. 4 shows an axial sectional view of a turnaround section according to the disclosure.
Figure 5:
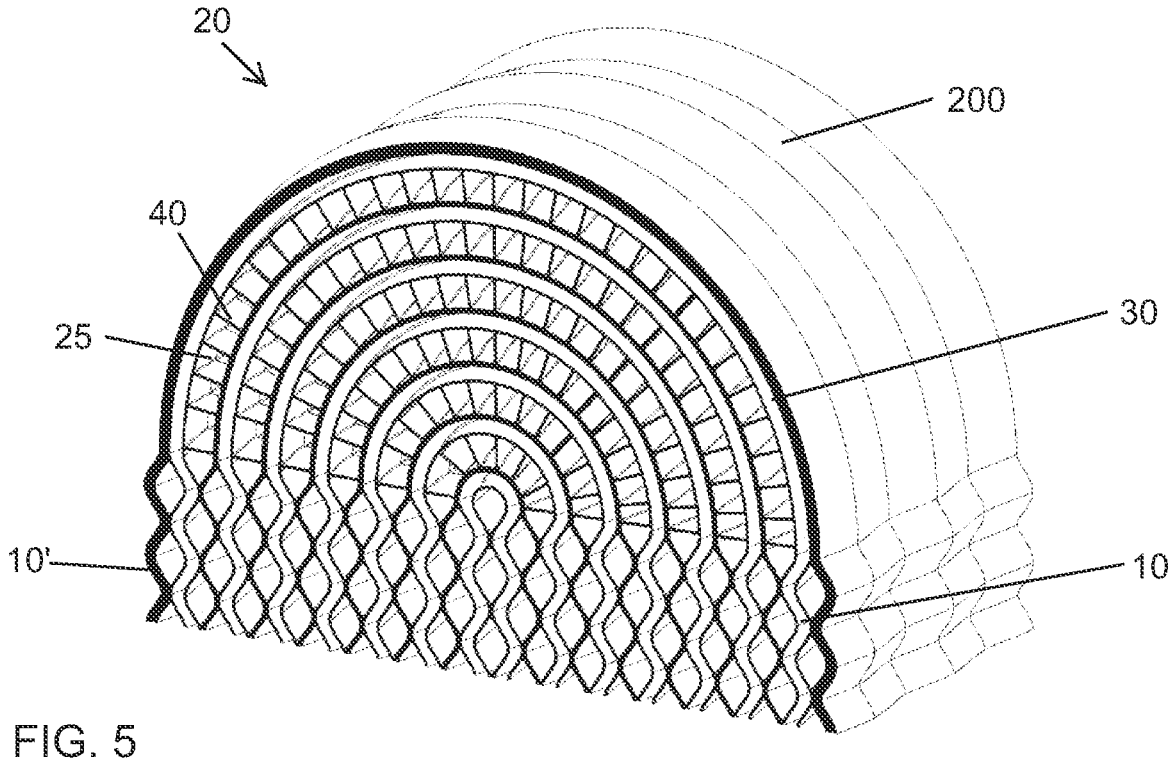
FIG. 5 is a 3D sectional view of a turnaround section according to the disclosure.

FIGS. 4 and 5 show other views of the turnaround section for a fuller understanding of the design.

The channels in the turnaround section provide for an improved distribution of the fluid in that section, enabling the fluid to flow more uniformly distributed into all return channels 10' and also allows the turnaround section to participate in the heat exchange process. The section can also be easily integrally formed with an AM manufactured main core section. This also allows for an overall reduction in size, weight and cost of the heat exchanger.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

The invention claimed is:

1. A turnaround section for use with a two-pass crossflow heat exchanger, the turnaround section comprising:

an arcuate housing;

a plurality of arcuate fluid flow channels radially spaced within the housing, each arcuate channel having a first end configured, in use, to receive a first fluid from flow channels of a heat exchanger core and a second end to return the first fluid to return channels of the core; and a plurality of separators between each adjacent pair of arcuate channels to form further channels between the arcuate channels that extend and provide for flow of a second fluid in a plane transverse to the plane of the arcuate channels;

wherein each arcuate channel is configured to receive the first fluid at its first end from two flow channels and to return the first fluid at its second end to two return channels.

2. The turnaround section of claim 1 formed by additive manufacture.

3. The turnaround section of claim 1, wherein the separators are in the form of fins extending from one of the adjacent pair of arcuate channels to the other.

4. The turnaround section of claim 1, wherein the first fluid is a hot fluid and the second fluid is a cold fluid.

5. A heat exchanger comprising:

a heat exchanger core comprising:

a first pass section comprising a plurality of flow channels for a first fluid to flow in a first direction; and a second pass section comprising a plurality of return channels for the first fluid to flow in a second direction opposite the first direction; and a turnaround section as recited in claim 1, wherein the turnaround section is between the first pass section and the second pass section and cause the fluid coming from the first pass section to change from the first direction to the second direction and enter the second pass section.

6. The heat exchanger of claim 5, further comprising second fluid channels flowing across the core in a direction transverse to the flow channels and the return channel.

7. The heat exchanger of claim 6, wherein the flow channels and the return channels are formed as wavy channels interwoven with the second fluid channels.

8. The heat exchanger of claim 5, wherein the core is formed by additive manufacture.

9. The heat exchanger of claim 8, wherein the core is formed integrally with the turnaround section.

10. The heat exchanger of claim 5, further comprising:

a manifold arranged to provide the first fluid to the flow channels.

11. A method of manufacturing a turnaround section as claimed in claim 1, comprising printing the turnaround section using 3-D printing.

* * * * *